US011465143B2

(12) United States Patent
Takeuchi et al.

(10) Patent No.: US 11,465,143 B2
(45) Date of Patent: Oct. 11, 2022

(54) REACTION PROCESSING VESSEL

(71) Applicant: Nippon Sheet Glass Company, Limited, Tokyo (JP)

(72) Inventors: Hidemitsu Takeuchi, Tokyo (JP); Osamu Kawaguchi, Tokyo (JP); Takashi Fukuzawa, Tokyo (JP)

(73) Assignee: Nippon Sheet Glass Company, Limited, Tokyo (JP)

( * ) Notice: Subject to any disclaimer, the term of this patent is extended or adjusted under 35 U.S.C. 154(b) by 0 days.

(21) Appl. No.: 16/856,147

(22) Filed: Apr. 23, 2020

(65) Prior Publication Data

US 2020/0384465 A1 Dec. 10, 2020

Related U.S. Application Data

(63) Continuation of application No. PCT/JP2019/034931, filed on Sep. 5, 2019.

(30) Foreign Application Priority Data

Jun. 7, 2019 (JP) ..... JP2019-106911

(51) Int. Cl.
*B01L 3/00* (2006.01)
*B01L 7/00* (2006.01)

(52) U.S. Cl.
CPC ..... *B01L 3/502715* (2013.01); *B01L 7/525* (2013.01); *B01L 2200/16* (2013.01);
(Continued)

(58) Field of Classification Search
CPC ..... B01L 3/502715; B01L 7/525; B01L 2200/16; B01L 2300/0816;
(Continued)

(56) References Cited

U.S. PATENT DOCUMENTS 8,961,903 B2 * 2/2015 Sadaba Champetier De Ribes .... B01L 3/5027 422/503
2009/0162929 A1 * 6/2009 Ikeda ..... B01L 7/525 435/303.1

(Continued)

FOREIGN PATENT DOCUMENTS

EP 2 562 247 B1 2/2016
JP 2007-51881 A 3/2007

(Continued)

OTHER PUBLICATIONS

International Search Report for PCT/JP2019/034931 dated Dec. 3, 2019.

(Continued)

*Primary Examiner* — William H. Beisner
*Assistant Examiner* — Danielle B Henkel
(74) *Attorney, Agent, or Firm* — Sughrue Mion, PLLC

(57) ABSTRACT

A reaction processing vessel includes a substrate and a groove-like channel formed on the upper surface of the substrate. The channel includes a high temperature serpiginous channel, a medium temperature serpiginous channel, and a high temperature braking channel and a medium temperature braking channel that are adjacent to the high temperature serpiginous channel and the medium temperature serpiginous channel, respectively. The respective cross-sectional areas of the high temperature braking channel and the medium temperature braking channel are larger than the respective cross-sectional areas of the high temperature serpiginous channel and the medium temperature serpiginous channel, respectively.

28 Claims, 12 Drawing Sheets

(52) U.S. Cl.
CPC ..... *B01L 2300/0816* (2013.01); *B01L 2300/0851* (2013.01); *B01L 2300/0858* (2013.01); *B01L 2300/0883* (2013.01); *B01L 2300/1805* (2013.01)

(58) Field of Classification Search
CPC ..... B01L 2300/0851; B01L 2300/0858; B01L 2300/0883; B01L 2300/1805
See application file for complete search history.

(56) References Cited

U.S. PATENT DOCUMENTS

| | | | | |
|---|---|---|---|---|
| 2010/0158756 | A1* | 6/2010 | Taylor | B01L 3/527 422/69 |
| 2011/0038758 | A1* | 2/2011 | Akaba | B01L 3/502761 422/69 |
| 2015/0190811 | A1* | 7/2015 | Tachibana | B01L 3/5027 435/305.1 |
| 2016/0199840 | A1* | 7/2016 | Tachibana | C12Q 1/686 435/6.12 |
| 2017/0175067 | A1* | 6/2017 | Tachibana | B01L 3/5027 |
| 2017/0239655 | A1* | 8/2017 | Laursen | B01F 5/0647 |
| 2018/0274019 | A1* | 9/2018 | Fukuzawa | G01N 37/00 |

FOREIGN PATENT DOCUMENTS

| | | | |
|---|---|---|---|
| JP | 2007-285777 | A | 11/2007 |
| JP | 2009-232700 | A | 10/2009 |
| JP | 2014-212705 | A | 11/2014 |
| JP | 2018-19606 | A | 2/2018 |
| JP | 2018-141685 | A | 9/2018 |
| RU | 2 385 940 | C1 | 4/2010 |
| RU | 2 549 694 | C2 | 4/2015 |
| RU | 2 666 925 | C1 | 9/2018 |
| WO | 2005121750 | A1 | 12/2005 |
| WO | 2006/054689 | A1 | 5/2006 |
| WO | 2015/019520 | A1 | 2/2015 |
| WO | 2015/019521 | A1 | 2/2015 |
| WO | 2015/019626 | A1 | 2/2015 |
| WO | 2016006612 | A1 | 1/2016 |
| WO | 2016/021158 | A1 | 2/2016 |
| WO | 2017/094674 | A1 | 6/2017 |
| WO | 2018235766 | A1 | 12/2018 |

OTHER PUBLICATIONS

Written Opinion of the International Searching Authority for PCT/JP2019/034931 dated Dec. 3, 2019.
Communication dated Nov. 26, 2019 from Japanese Patent Office in JP Application No. 2019-106911.
Communication dated Feb. 16, 2021 by the Russian Patent Office in application No. 2020122243.
Communication dated Nov. 4, 2020, issued by the Japanese Patent Office in Japanese Patent No. 6652673.
Toshihiro Kamei, "Development of ultra-compact fluorescence detection module for microfluidic biochemical diagnosis Key technology enabling rapid near patient diagnosis at home or bedside", Nanotechnology, Materials and Manufacturing, AIST Today, vol. 14, No. 9, 2014, pp. 1-4 (5 pages total).
Communication dated Aug. 25, 2020 by the Japanese Patent Office in application No. 2019-106911 (U.S. Pat. No. 6,652,673).
Extended European Search Report dated Jun. 21, 2021 from the European Patent Office in EP Application No. 19872250.6.
Notification of reasons for refusal to correct dated Feb. 9, 2021 from the Japanese Patent Office in JP Patent Opposition No. 2020-700634 (U.S. Pat. No. 6,652,673).
Notice of reason for Revocation dated Apr. 13, 2021 from the Japanese Patent Office in JP Patent Opposition No. 2020-700634 (U.S. Pat. No. 6,652,673).
Communication dated Jan. 12, 2022, issued by the Intellectual Property Office of India in application No. 202017019756.
Decision on Opposition dated Jan. 6, 2022 issued from the Japanese Patent Office in Japanese Patent No. 6652673.
Office Action dated Jul. 5, 2022 in Indonesian Application No. P00202003802.
Communication dated Aug. 2, 2022, issued by the Japanese Patent Office in Japanese Patent Application No. 2020-008997.

* cited by examiner

REACTION PROCESSING VESSEL

BACKGROUND OF THE INVENTION

Field of the Invention

The present invention relates to reaction processing vessels used for polymerase chain reactions (PCR).

Background Art

Genetic testing is widely used for examinations in a wide variety of medical fields, identification of farm products and pathogenic microorganisms, safety assessment for food products, and even for examinations for pathogenic viruses and a variety of infectious diseases. In order to detect with high sensitivity a minute amount of DNA, methods of analyzing the resultant obtained by amplifying a portion of DNA are known. Above all, a method that uses PCR is a remarkable technology where a certain portion of a very small amount of DNA collected from an organism or the like is selectively amplified.

In PCR, a predetermined thermal cycle is applied to a sample in which a biological sample containing DNA and a PCR reagent consisting of primers, enzymes, and the like are mixed so as to cause denaturation, annealing, and elongation reactions to be repeated so that a specific portion of DNA is selectively amplified.

It is a common practice to perform PCR by putting a predetermined amount of a target sample into a PCR tube or a reaction processing vessel such as a microplate (microwell) in which a plurality of holes are formed. However, in recent years, PCR using a reaction processing vessel (also referred to as "reaction treatment chip") provided with a micro-channel that is formed on a substrate is practiced (e.g. Patent Documents 1-3).

[Patent Document 1] Japanese Patent Application Publication No. 2009-232700

[Patent Document 2] Japanese Patent Application Publication No. 2007-51881

[Patent Document 3] Japanese Patent Application Publication No. 2007-285777

SUMMARY OF THE INVENTION

In a PCR using a reaction processing vessel as described above, in order to apply a thermal cycle to a sample, a part of the channel of the reaction processing vessel is formed to be a serpiginous channel, and the serpiginous channel is maintained to be at a predetermined temperature (for example, about 95° C. or 55° C.) by an external heater or the like. The serpiginous channel is a channel where a turn is continuously made by combining curved channels and straight channels. By making the channel for giving a thermal cycle to the sample to be a serpiginous channel, the efficiency of heating by an external heater can be improved, and a limited substrate area can be used effectively.

The sample in the channel of the reaction processing vessel can be moved by controlling the air flow into the channel or the pressure inside the channel. However, in order to properly apply a thermal cycle to the sample, it is necessary to accurately stop the sample in the serpiginous channel maintained to be at a predetermined temperature.

In this background, a purpose of the present invention is to provide a reaction processing vessel capable of improving the accuracy of stopping a sample in a serpiginous channel.

A reaction processing vessel according to one embodiment of the present invention is a reaction processing vessel that includes a substrate and a groove-like channel formed on a principal surface of the substrate, wherein the channel includes a serpiginous channel and a braking channel adjacent to the serpiginous channel. The cross-sectional area of the braking channel is larger than the cross-sectional area of the serpiginous channel.

Given that the cross-sectional area of the serpiginous channel is denoted by Sr and that the cross-sectional area of the braking channel is denoted by Sb, a cross-sectional area ratio Sb/Sr may be in a range of $1<Sb/Sr\leq1.8$. The cross-sectional area ratio Sb/Sr may be in a range of $1.02\leq Sb/Sr\leq1.5$. The cross-sectional area ratio Sb/Sr may be in a range of $1.02\leq Sb/Sr\leq1.2$.

The serpiginous channel and the braking channel may have an opening, a bottom surface, and side surfaces formed in a tapered shape expanding from the bottom surface toward the opening.

The serpiginous channel may have an opening width of 0.55 mm to 0.95 mm, a bottom surface width of 0 mm to 0.95 mm, a depth of 0.5 mm to 0.9 mm, and a taper angle of 0° to 45°. The braking channel may have an opening width of 0.65 mm to 1.05 mm, a bottom surface width of 0 mm to 1.05 mm, a depth of 0.5 mm to 0.9 mm, and a taper angle of 0° to 45°.

The connecting parts between the bottom surface and the side surfaces may have a curved surface. The curvature radius of the connecting parts may be 0.2 mm to 0.4 mm.

The serpiginous channel may include a bent part in plan view. The curvature radius of the bent part may be 0.5 mm to 10 mm.

Another embodiment of the present invention also relates to a reaction processing vessel. This reaction processing vessel is a reaction processing vessel that includes a substrate and a groove-like channel formed on a principal surface of the substrate, wherein the channel includes a serpiginous channel and a detection channel that is irradiated with excitation light in order to detect fluorescence from a sample flowing inside the channel. The cross-sectional area of the detection channel is larger than the cross-sectional area of the serpiginous channel.

Given that the cross-sectional area of the serpiginous channel is denoted by Sr and that the cross-sectional area of the detection channel is denoted by Sd, a cross-sectional area ratio Sd/Sr may be in a range of $1<Sd/Sr\leq1.8$. The cross-sectional area ratio Sd/Sr may be in a range of $1.02\leq Sd/Sr\leq1.5$. The cross-sectional area ratio Sd/Sr may be in a range of $1.02\leq Sd/Sr\leq1.2$.

The serpiginous channel and the detection channel may have an opening, a bottom surface, and side surfaces formed in a tapered shape expanding from the bottom surface toward the opening.

The serpiginous channel may have an opening width of 0.55 mm to 0.95 mm, a bottom surface width of 0 mm to 0.95 mm, a depth of 0.5 mm to 0.9 mm, and a taper angle of 0° to 45°. The detection channel may have an opening width of 0.7 mm to 1.2 mm, a bottom surface width of 0.15 mm to 1.2 mm, a depth of 0.5 mm to 1.2 mm, and a taper angle of 0° to 45°.

The bottom surface of the detection channel may be formed on a plane parallel to the principal surface of the substrate.

Connecting parts between the bottom surface and the side surfaces may be formed in an angular shape.

Still another embodiment of the present invention also relates to a reaction processing vessel. This reaction processing vessel is a reaction processing vessel that includes a substrate and a groove-like channel formed on a principal surface of the substrate, wherein the channel includes a serpiginous channel, a braking channel adjacent to the serpiginous channel, and a detection channel that is irradiated with excitation light in order to detect fluorescence from a sample flowing inside the channel. The cross-sectional area of the braking channel is larger than the cross-sectional area of the serpiginous channel, and the cross-sectional area of the detection channel is larger than the cross-sectional area of the serpiginous channel.

Still another embodiment of the present invention also relates to a reaction processing vessel. This reaction processing vessel is a reaction processing vessel that includes a substrate, a groove-like channel formed on a principal surface of the substrate, a branch channel branched from the channel, and a sample introduction port provided in the branch channel, wherein a plurality of reaction regions each maintained at a predetermined temperature when the reaction processing vessel is used are set for the substrate, and wherein the distance between a reaction region closest to the branch channel and to the sample introduction port among the plurality of reaction regions and the branch channel and the sample introduction port is 5 mm or more.

Still another embodiment of the present invention relates to a reaction processing method using the reaction processing vessel. This method includes: introducing a sample into the channel via the sample introduction port and the branch channel; heating the plurality of reaction regions each to a predetermined temperature; and moving the sample between the plurality of reaction regions and subjecting the sample to PCR. The sample remaining in the branch channel and the sample introduction port is not pushed out into the channel during the PCR.

Still another embodiment of the present invention also relates to a reaction processing vessel. This reaction processing vessel is a reaction processing vessel that includes a substrate, a groove-like channel formed on a principal surface of the substrate, a pair of filters provided at the respective ends of the channel, a branch channel branched from the channel, and a sample introduction port provided in the branch channel, wherein given that the volume of the channel from the sample introduction port to a filter closest to the sample introduction port is denoted by Vf and that the volume of the sample introduced from the sample introduction port is denoted by Vs, the following is satisfied: $k \times Vs < Vf$ (where k represents a real number of 0.1 to 10).

Still another embodiment of the present invention also relates to a reaction processing vessel. This reaction processing vessel is a reaction processing vessel that includes a substrate, a groove-like channel formed on a principal surface of the substrate, a pair of filters provided at the respective ends of the channel, a branch channel branched from the channel, and a sample introduction port provided in the branch channel, wherein, when the volume of the sample introduced from the sample introduction port is 1 μL to 50 μL, the length of the channel from the sample introduction port to a filter closest to the sample introduction port is 2 mm to 200 mm.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF THE INVENTION

Figure 1:
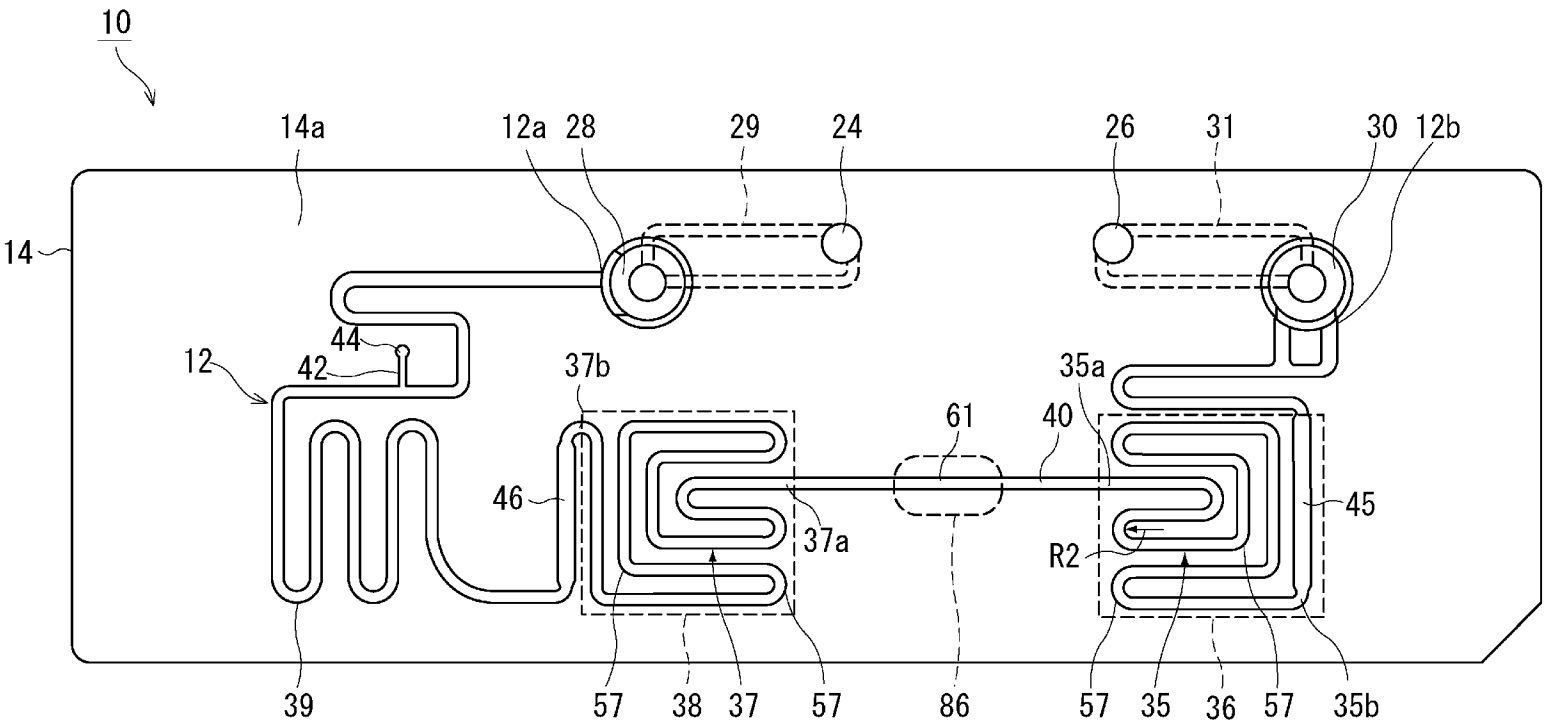
FIG. 1 is a plan view of a substrate provided in a reaction processing vessel according to the first embodiment of the present invention.

An explanation will be given in the following regarding a reaction processing vessel according to an embodiment of the present invention. The same or equivalent constituting elements, members, and processes illustrated in each drawing shall be denoted by the same reference numerals, and duplicative explanations will be omitted appropriately. Further, the embodiments do not limit the invention and are shown for illustrative purposes, and not all the features described in the embodiments and combinations thereof are necessarily essential to the invention.

First Embodiment

Figure 2:
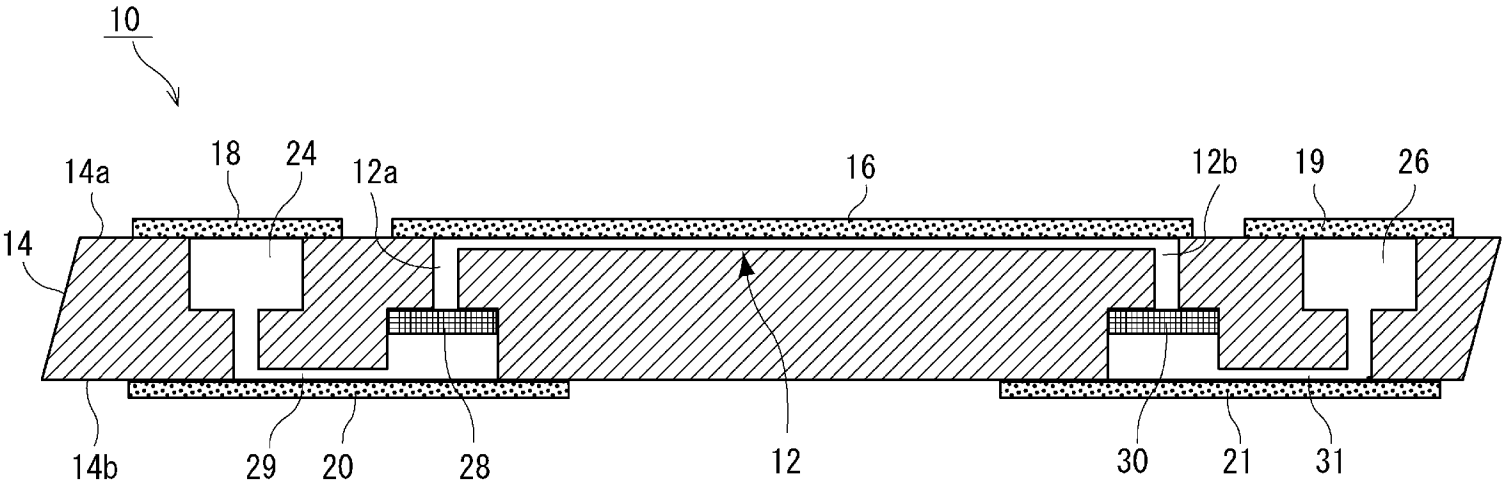
FIG. 2 is a diagram for explaining the cross-sectional structure of the reaction processing vessel.

A reaction processing vessel according to the first embodiment of the present invention is formed of a substrate, a sealing film attached to the substrate, and a filter. FIG. 1 is a plan view of a substrate provided in the reaction processing vessel according to the first embodiment of the present invention. FIG. 2 is a diagram for explaining a cross-sectional structure of the reaction processing vessel. FIG. 2 is a diagram for explaining the positional relationship between a channel, the film, and the filter that are formed on the substrate, and it should be noted that the diagram is different from the cross-sectional view of the implemented reaction processing vessel.

A reaction processing vessel 10 includes a resin substrate 14 having a groove-like channel 12 formed on an upper surface 14*a* thereof, a channel sealing film 16, a first sealing film 18, and a second sealing film 19, which are attached on the upper surface 14*a* of the substrate 14, a third sealing film 20, a fourth sealing film 21, and a fifth film (not shown), which are attached on a lower surface 14*b* of the substrate 14, and a first filter 28 and a second filter 30, which are arranged inside the substrate 14.

The substrate 14 is preferably formed of a material that is stable under temperature changes and is resistant to a sample solution that is used. Further, the substrate 14 is preferably formed of a material that has good moldability, a good transparency and barrier property, and a low self-fluorescent property. As such a material, a resin such as acryl, polypropylene, silicone, or the like, particularly a cyclic polyolefin resin is preferred.

The groove-like channel 12 is formed on the upper surface 14*a* of the substrate 14. In the reaction processing vessel 10, most of the channel 12 is formed in the shape of a groove exposed on the upper surface 14*a* of the substrate 14. This is for allowing for easy molding by injection molding using a metal mold. In order to seal this groove so as to make use of the groove as a channel, the channel sealing film 16 is attached on the upper surface 14*a* of the substrate 14. Further, in order to more advantageously produce the substrate in an industrial manner by the injection molding method, the structure of the channel may include a side surface having a certain angle with respect to the principal surface of the substrate, which is referred to as a so-called "draft angle".

The channel sealing film 16 may be sticky on one of the principal surfaces thereof or may have a functional layer that exhibits stickiness or adhesiveness through pressing, energy irradiation with ultraviolet rays or the like, heating, etc., formed on one of the principal surfaces. Thus, the channel sealing film 16 has a function of being easily able to become integral with the upper surface 14*a* of the substrate 14 while being in close contact with the upper surface 14*a*. The channel sealing film 16 is desirably formed of a material, including an adhesive compound, that has a low self-fluorescent property. In this respect, a transparent film made of a resin such as a cycloolefin polymer, polyester, polypropylene, polyethylene or acrylic is suitable but is not limited thereto. Further, the channel sealing film 16 may be formed of a plate-like glass or resin. Since rigidity can be expected in this case, the channel sealing film 16 is useful for preventing warpage and deformation of the reaction processing vessel 10.

A first filter 28 is provided at one end 12*a* of the channel 12. A second filter 30 is provided at the other end 12*b* of the channel 12. The pair, the first filter 28 and the second filter 30, provided at respective ends of the channel 12, prevents contamination so that the amplification of target DNA and the detection of the amplification are not interrupted by PCR or so that the quality of the target DNA does not deteriorate. Regarding the dimensions of the first filter 28 and the second filter 30, the first filter 28 and the second filter 30 are formed so as to fit without any gap in a filter installation space formed in the substrate 14.

A first air communication port 24 communicating with one end 12*a* of the channel 12 via an air introduction passage 29 and the first filter 28 is formed in the substrate 14. In the same way, a second air communication port 26 communicating with the other end 12*b* of the channel 12 via an air introduction passage 31 and the second filter 30 is formed in the substrate 14. The pair, the first air communication port 24 and the second air communication port 26, is formed so as to be exposed on the upper surface 14*a* of the substrate 14.

In the first embodiment, as the first filter 28 and the second filter 30, those with good low impurity characteristics and with air permeability and water repellency or oil repellency are used. The first filter 28 and the second filter 30 are preferably, for example, porous resins, sintered compacts of resin, or the like, and examples of a fluorine-containing resin include, although not limited to, PTFE (polytetrafluoroethylene), PFA (perfluoroalkoxyalkane), FEP (perfluoroethylene propene copolymer), ETFE (ethylene tetrafluoroethylene copolymer), etc. Further, as a filter made of PTFE (polytetrafluoroethylene), although not limited to this, PF020 (manufactured by ADVANTEC Group) or the like can be used. Further, as the first filter 28 and the second filter 30, those whose surface is water-repellent treated through coating with a fluorine-containing resin can be used. Other filter materials include polyethylene, polyamide, polypropylene, and the like, and any material that can prevent contamination of the sample to be subjected to PCR and that does not interfere with PCR may be used. A material that has a property of allowing the passage of the air while preventing the passage of a liquid is even better, and the performance and the quality of the material are not limited as long as the material satisfies some of these requirements for the required performance.

In the reaction processing vessel 10, a reaction region where a plurality of levels of temperature can be controlled by a reaction processing apparatus described later is set in order to apply a thermal cycle to the sample flowing through the channel 12. A thermal cycle can be applied to a sample by moving the sample such that the sample continuously reciprocates in the channel inside the reaction region where the temperatures of a plurality of levels are maintained.

In the first embodiment, the reaction region includes a high temperature region 36 and a medium temperature region 38. The high temperature region 36 is a region corresponding to the effective surface of a high temperature heater when the reaction processing vessel 10 is mounted on the reaction processing apparatus and is maintained at a relatively high temperature (for example, about 95° C.). The medium temperature region 38 is a region corresponding to the effective surface of a medium temperature heater when the reaction processing vessel 10 is mounted on the reaction processing apparatus and is maintained at a temperature lower than that of the high temperature region 36 (for example, about 62° C.)

The high temperature region 36 and the medium temperature region 38 each include a serpiginous shape channel where a turn is continuously made by combining curved channels and straight channels. That is, the high temperature region 36 includes a high temperature serpiginous channel 35, and the medium temperature region 38 includes a medium temperature serpiginous channel 37. Since such a serpiginous channel can effectively utilize the limited area of the substrate 14, the substantial size of the reaction processing vessel can be reduced, contributing to the downsizing of the reaction processing apparatus. Further, a limited effective area of a heater constituting a temperature control system described later can be effectively used, and temperature variance in the reaction region is easily reduced.

As shown in FIG. 1, a connection channel 40 is formed between one end 35*a* of the high temperature serpiginous channel 35 and one end 37*a* of the medium temperature serpiginous channel 37. This connection channel 40 is a straight channel. At a substantially central part of the connection channel 40, when the reaction processing vessel 10 is mounted in the reaction processing apparatus, a region (referred to as "fluorescence detection region") 86 that is irradiated with excitation light in order to detect fluorescence from a sample flowing inside the channel is set. The channel included in a fluorescence detection region 86 is referred to as "detection channel 61".

The other end 35*b* of the high temperature serpiginous channel 35 communicates with a high temperature braking channel 45. The high temperature braking channel 45 is formed adjacent to the high temperature serpiginous channel 35 and on the back side (on the second filter 30 side) of the high temperature serpiginous channel 35 when viewed from the connection channel 40. The other end 37*b* of the medium temperature serpiginous channel 37 communicates with a medium temperature braking channel 46. The medium temperature braking channel 46 is formed adjacent to the medium temperature serpiginous channel 37 and on the back side (on the first filter 28 side) of the medium temperature serpiginous channel 37 when viewed from the connection channel 40.

The high temperature braking channel 45 is a straight channel and is formed such that the cross-sectional area thereof is larger than the cross-sectional area of the high temperature serpiginous channel 35. In the same way, the medium temperature braking channel 46 is a straight channel and is formed such that the cross-sectional area thereof is larger than the cross-sectional area of the medium temperature serpiginous channel 37. As will be described later in detail, the high temperature braking channel 45 and the medium temperature braking channel 46 each have a role of exerting a braking action on the sample flowing through the high temperature serpiginous channel 35 and the medium temperature serpiginous channel 37, respectively.

In the first embodiment, as shown in FIG. 1, both the high temperature serpiginous channel 35 and the high temperature braking channel 45 are included in the high temperature region 36. On the other hand, with respect to the medium temperature region 38, although the medium temperature serpiginous channel 37 is included in the medium temperature region 38, the medium temperature braking channel 46 is not included in the medium temperature region 38. When stopping the sample in the high temperature region 36 during the PCR, the sample exists in at least both the high temperature serpiginous channel 35 and the high temperature braking channel 45. On the other hand, when stopping the sample in the medium temperature region 38 during the PCR, the sample exists at least in the medium temperature serpiginous channel 37. The sample existing in channels included in the high temperature region 36 and the medium temperature region 38 is substantially heated and maintained at a predetermined temperature for a certain period of time. Thereby, reactions such as denaturation and annealing occur.

The high temperature braking channel 45 communicates with the second air communication port 26 via the second filter 30 and the air introduction passage 31. The medium temperature braking channel 46 communicates with a buffer channel (spare channel) 39. The buffer channel 39 communicates with the first air communication port 24 via the first filter 28 and the air introduction passage 29.

A branch point is provided in a part of the buffer channel 39, and a branch channel 42 branches from the branch point. A sample introduction port 44 is formed at the distal end of the branch channel 42 so as to be exposed on the lower surface 14*b* of the substrate 14. The buffer channel 39 can be used as a temporary sample standby channel used when the reaction processing vessel 10 is introduced into the reaction processing apparatus after a predetermined amount of a sample is introduced from the sample introduction port 44.

As shown in FIG. 2, the first sealing film 18 is attached to the upper surface 14*a* of the substrate 14 such that the first air communication port 24 is sealed. The second sealing film 19 is attached to the upper surface 14*a* of the substrate 14 such that the second air communication port 26 is sealed. The third sealing film 20 is attached to the lower surface 14*b* of the substrate 14 such that the air introduction passage 29 and the first filter 28 are sealed. The fourth sealing film 21 is attached to the lower surface 14*b* of the substrate 14 such that the air introduction passage 31 and the second filter 30 are sealed. The fifth sealing film (not shown) is attached to the lower surface 14*b* of the substrate 14 such that the sample introduction port 44 is sealed. As these sealing films, transparent films formed of a resin such as a cycloolefin polymer, polyester, polypropylene, polyethylene, or acrylic as the base material can be used. In a state where all the sealing films including the channel sealing film 16 are attached, the entire channel forms a closed space.

When connecting a liquid feeding system, which will be described later, to the reaction processing vessel 10, the first sealing film 18 and the second sealing film 19 sealing the first air communication port 24 and the second air communication port 26 are peeled off, and tubes provided in the liquid feeding system are connected to the first air communication port 24 and the second air communication port 26. Alternatively, the connection may be realized by perforating the first sealing film 18 and the second sealing film 19 with a hollow needle (injection needle with a pointed tip) provided in the liquid feeding system. In this case, the first sealing film 18 and the second sealing film 19 are preferably films made of a material that is easily perforated by the needle and/or have a thickness that is easily perforated by the needle.

Introduction of a sample into the channel 12 through the sample introduction port 44 is performed by once peeling the fifth sealing film from the substrate 14, and, after the introduction of a predetermined amount of sample, the fifth sealing film is put back being attached to the lower surface 14*b* of the substrate 14 again. At this time, since the air inside the channel is pushed due to the introduction of the sample, the second sealing film may be peeled off in advance in order to release the air. Therefore, as the fifth sealing film, a film is desired that is sticky enough to hold up through several cycles of attaching and peeling. Alternatively, as the fifth sealing film, a new film may be attached after the introduction of a sample. In this case, the importance of the property related to repetitive attaching and peeling can be lessened.

The method for the introduction of a sample to the sample introduction port 44 is not particularly limited. For example, an appropriate amount of the sample may be directly introduced through the sample introduction port 44 using a pipette, a dropper, a syringe, or the like. Alternatively, a method of introduction may be used that is performed while preventing contamination via a needle chip in which a filter made of porous PTFE or polyethylene is incorporated. In general, many types of such needle chips are sold and can be obtained easily, and the needle chips can be used while being attached to the tip of a pipette, a dropper, a syringe, or the like. Furthermore, the sample may be moved to a predetermined position in the channel 12 by discharging and introducing the sample by a pipette, a dropper, a syringe, or the like and then further pushing the sample through pressurization. Although not shown, a plurality of sample introduction ports may be provided. In this case, by using an area of the buffer channel 39 between the plurality of sample introduction ports, it is possible to provide a function capable of easily measuring a sample of a fixed volume that is to be subjected to a reaction process such as PCR. For the detailed method used at this time, the matters described in Japanese Patent Application Publication No. 2016-19606 can be referred to.

The sample includes, for example, those obtained by adding a thermostable enzyme and four types of deoxyribonucleoside triphosphates (dATP, dCTP, dGTP, dTTP) as PCR reagents to a mixture containing one or more types of DNA. Further, a primer that specifically reacts with the DNA subjected to reaction processing, and in some cases, a fluorescent probe such as TaqMan (TaqMan is a registered trademark of Roche Diagnostics Gesellschaft mit beschränkter Haftung) or SYBR Green (SYBR is a registered trademark of Molecular Probes, Incorporated) are mixed. Commercially available real-time PCR reagent kits and the like can be also used.

Figure 3:
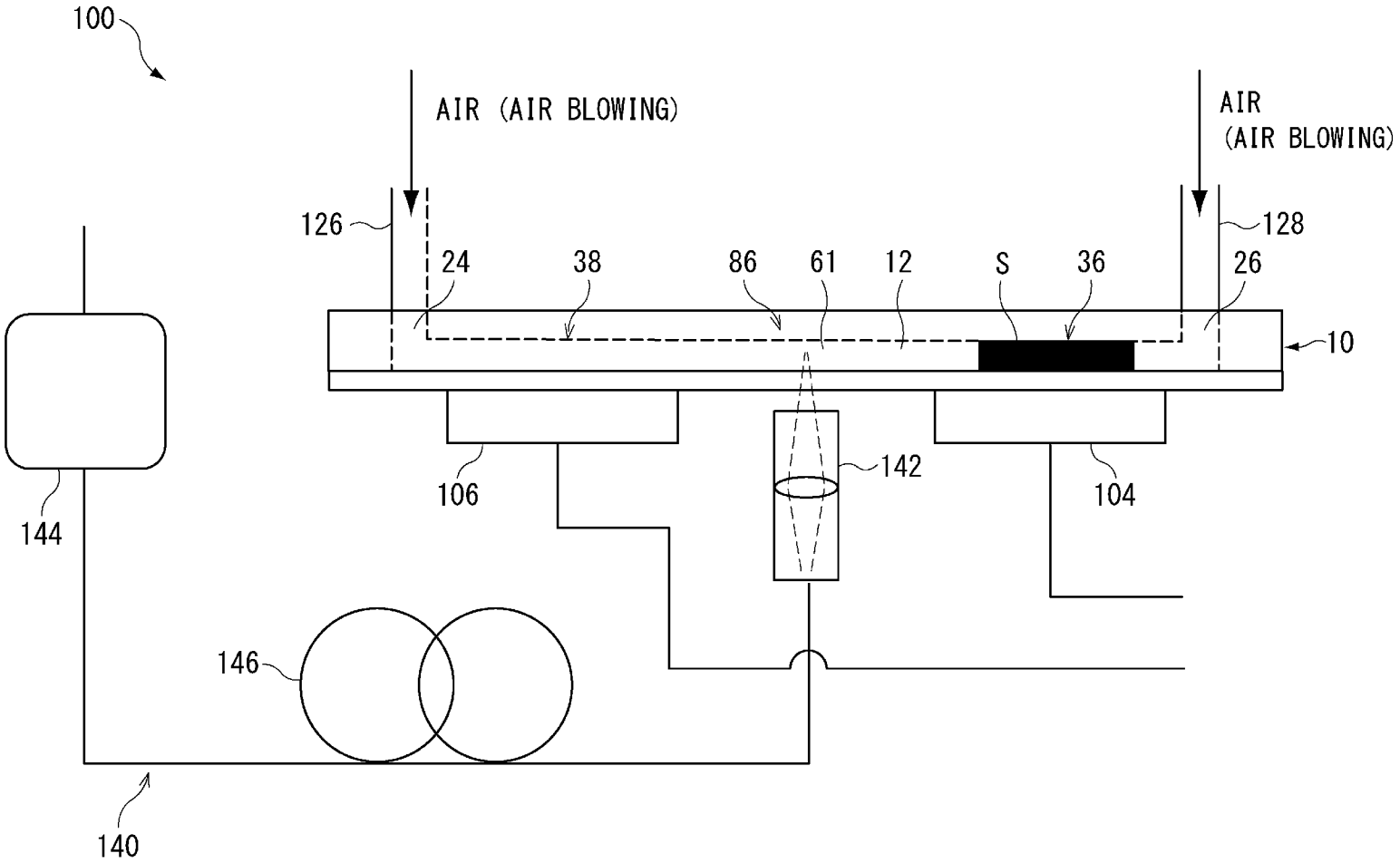
FIG. 3 is a schematic diagram for explaining a reaction processing apparatus capable of using a reaction processing vessel.

FIG. 3 is a schematic diagram for explaining a reaction processing apparatus 100 capable of using a reaction processing vessel 10 and is particularly only a portion directly related to the reaction processing vessel 10 that is conceptually extracted.

The reaction processing apparatus 100 is provided with a container installation portion (not shown) in which the reaction processing vessel 10 is set, a high temperature heater 104 for heating the high temperature region 36 of the channel 12, a medium temperature heater 106 for heating the medium temperature region 38 of the channel 12, and a temperature sensor (not shown) such as, for example, a thermocouple or the like for measuring the actual temperature of each reaction region. Each heater may be, for example, a resistance heating element, a Peltier element, or the like. By these heaters, a suitable heater driver (not shown), and a control device (not shown) such as a microcomputer, the high temperature region 36 in the channel 12 of the reaction processing vessel 10 is maintained to be approximately 95° C., and the medium temperature region 38 is maintained to be approximately 62° C. Thus, the temperature of each reaction region of a thermal cycle region is set.

The reaction processing apparatus 100 is further provided with a fluorescence detector 140. As described above, a predetermined fluorescent probe is added to a sample S. Since the intensity of a fluorescence signal emitted from the sample S increases as the amplification of the DNA proceeds, the intensity value of the fluorescence signal can be used as an index serving as a decision material for the progress of the PCR or the termination of the reaction.

As the fluorescence detector 140, an optical fiber-type fluorescence detector FLE-510 manufactured by Nippon Sheet Glass Co., Ltd., can be used, which is a very compact optical system that allows for rapid measurement and the detection of fluorescence regardless of whether the place is a lighted place or a dark place. This optical fiber-type fluorescence detector allows the wavelength characteristic of the excitation light/fluorescence to be tuned such that the wavelength characteristic is suitable for the characteristic of fluorescence emitted from the sample S and thus allows an optimum optical and detection system for a sample having various characteristics to be provided. Further, the optical fiber-type fluorescence detector is suitable for detecting fluorescence from a sample existing in a small or narrow region such as a channel because of the small diameter of a ray of light brought by the optical fiber-type fluorescence detector and is also excellent in response speed.

The optical fiber-type fluorescence detector 140 is provided with an optical head 142, a fluorescence detector driver 144, and an optical fiber 146 connecting the optical head 142 and the fluorescence detector driver 144. The fluorescence detector driver 144 includes a light source for excitation light (LED, a laser, or a light source adjusted to emit other specific wavelengths), an optical fiber-type multiplexer/demultiplexer and a photoelectric conversion device (PD, APD, or a light detector such as a photomultiplier) (neither of which is shown), and the like and formed of a driver or the like for controlling these. The optical head 142 is formed of an optical system such as a lens and has a function of directionally irradiating the sample with excitation light and collecting fluorescence emitted from the sample. The collected fluorescence is separated from the excitation light by the optical fiber-type multiplexer/demultiplexer inside the fluorescence detector driver 144 through the optical fiber 146 and converted into an electric signal by the photoelectric conversion element. As the optical fiber-type fluorescence detector, those described in Japanese Patent Application Publication No. 2010-271060 can be used. The optical fiber-type fluorescence detector can be further modified so as to allow for coaxial detection for a plurality of wavelengths using a single or a plurality of optical heads. The invention described in WO 2014/003714 can be used fora fluorescence detector for a plurality of wavelengths and signal processing thereof.

In the reaction processing apparatus 100, the optical head 142 is arranged such that fluorescence from the sample S in the detection channel 61 can be detected. Since the reaction progresses while the sample S is repeatedly moved in a reciprocating manner in the channel such that predetermined DNA contained in the sample S is amplified, by monitoring a change in the amount of detected fluorescence, the progress of the DNA amplification can be learned in real time. Further, in the reaction processing apparatus 100, an output value from the fluorescence detector 140 is utilized for controlling the movement of the sample S. For example, an output value from the fluorescence detector 140 may be transmitted to a control device and may be used as a parameter at the time of controlling a liquid feeding system described later. The fluorescence detector is not limited to an optical fiber-type fluorescence detector as long as the fluorescence detector exhibits the function of detecting fluorescence from a sample.

The reaction processing apparatus 100 is further provided with a liquid feeding system (not shown) for moving and stopping the sample S inside the channel 12 of the reaction processing vessel 10. Although the liquid feeding system is not limited to this, the sample S can be moved in one direction inside the channel 12 by sending (air blowing) the air from one of the first air communication port 24 and the second air communication port 26 through the first air communication port 24 or the second air communication port 26. Further, the liquid feeding system can be stopped at a predetermined position by stopping the air supply to the channel or by equalizing the pressure on both sides of the sample S inside the channel 12.

In the liquid feeding system, a syringe pump, a diaphragm pump, a blower, or the like can be used as a means (air blowing means) having a function of air blowing and pressurizing. Further, as those that have a function of stopping the sample S at a predetermined position, combinations of an air blowing means, a three-way valve (three-port valve), and the like can be used. For example, an embodiment is possible where first and second three-way valves are provided and where each port is connected in the first three-way valve such that the first port (common port) thereof is connected to the first air communication port, the second port is connected to the above-described air blowing means, and the third port is opened to the atmospheric pressure and each port is connected in the second three-way valve such that the first port (common port) thereof is connected to the second air communication port, the second port is connected to the above-described air blowing means, and the third port is opened to the atmospheric pressure. Specific embodiments thereof are described in, for example, JP 4-325080 and JP 2007-285777. For example, the sample S is moved in one direction by operating a three-way valve connected to one of the air communication ports such that the air blowing means and the air communication port communicate with each other and by operating a three-way valve connected to the other air communication port such that the air communication port communicates with the atmospheric pressure. Subsequently, the sample S is stopped by operating both of the three-way valves such that both of the air communication ports communicate with the atmospheric pressure.

Further, the operation of the three-way valves and the liquid feeding means can be performed by the control device via an appropriate driver. In particular, the fluorescence detector 140 arranged as described above transmits an output value that is based on the obtained fluorescence signal to the control device such that the control device recognizes the position and passage of the sample S in the channel 12, thereby allowing the control device to control the liquid feeding system including the three-way valves and the liquid feeding means.

Therefore, by sequentially and continuously operating the three-way valves connected to the respective sides of the channel 12, the sample S is continuously reciprocated between the high temperature region 36 and the medium temperature region 38 in the channel 12. This allows an appropriate thermal cycle to be applied to the sample S.

Figure 4A:
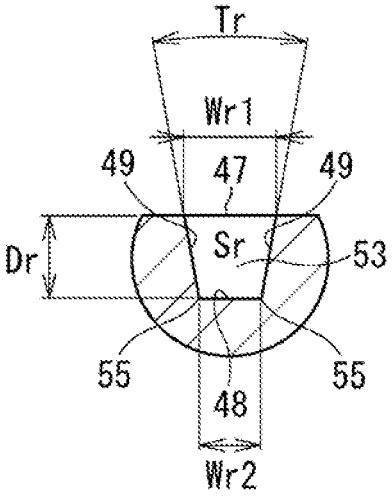
FIGS. 4A and 4B are diagrams for explaining the shape of a channel in the substrate of the reaction processing vessel shown in FIG. 1.
Figure 4B:
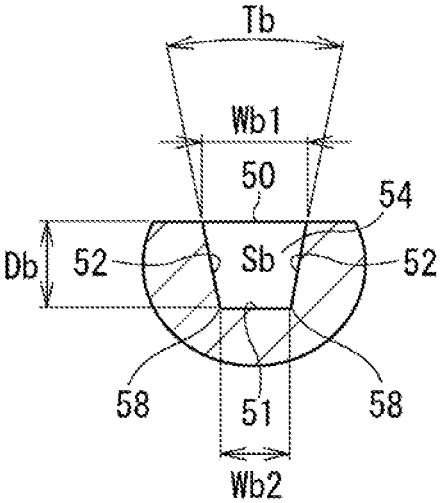

FIGS. 4A and 4B are diagrams for explaining the shape of the channel 12 in the substrate 14 of the reaction processing vessel 10 shown in FIG. 1. FIG. 4A shows a cross section of a serpiginous channel 53. FIG. 4B shows a cross section of a braking channel 54. The serpiginous channel 53 corresponds to the high temperature serpiginous channel 35 and the medium temperature serpiginous channel 37. The braking channel 54 corresponds to the high temperature braking channel 45 and the medium temperature braking channel 46.

As shown in FIG. 4A, the serpiginous channel 53 is a trapezoidal channel and has an opening 47, a bottom surface 48, and side surfaces 49 located on the respective sides of the bottom surface 48. The side surfaces 49 are formed in a tapered shape expanding from the bottom surface 48 toward the opening 47. Parameters defining the shape and dimensions of the serpiginous channel 53 include a depth Dr, a taper angle Tr, an opening width Wr1, a bottom surface width Wr2, and a cross-sectional area Sr. The bottom surface 48 and the side surfaces 49 are flat, and connecting parts 55 between the bottom surface 48 and the side surfaces 49 have an angular shape.

As shown in FIG. 4B, the braking channel 54 is also a trapezoidal channel and has an opening 50, a bottom surface 51, and side surfaces 52 located on the respective sides of the bottom surface 51. The side surfaces 52 are formed in a tapered shape expanding from the bottom surface 51 toward the opening 50. Parameters defining the shape and dimensions of the braking channel 54 include a depth Db, a taper angle Tb, an opening width Wb1, a bottom surface width Wb2, and a cross-sectional area Sb. The bottom surface 51 and the side surfaces 52 are flat, and connecting parts 58 between the bottom surface 51 and the side surfaces 52 have an angular shape.

In the reaction processing vessel 10 according to the first embodiment, the cross-sectional area Sb of the braking channel 54 is larger than the cross-sectional area Sr of the serpiginous channel 53. The moving speed of the sample varies depending on the cross-sectional area of the channel. In general, as the cross-sectional area of the channel increases, the moving speed of the sample decreases. By making the cross-sectional area Sb of the braking channel 54 larger than the cross-sectional area Sr of the serpiginous channel 53, a braking action is generated on the sample. Thus, the movement/stop control of the sample by the liquid feeding system of the reaction processing apparatus 100 becomes easy, and the accuracy of stopping the sample at a predetermined position in the serpiginous channel 53 can be improved. Further, even when the sample is introduced into the channel 12 in an amount larger than a predetermined amount, an excessive overrun of the sample from the serpiginous channel 53 can be suppressed.

The cross-sectional area ratio Sb/Sr of the cross-sectional area Sr of the serpiginous channel 53 and the cross-sectional area Sb of the braking channel 54 may be in a range of $1<Sb/Sr\leq1.8$, preferably in a range of $1.02\leq Sb/Sr\leq1.5$, and more preferably in a range of $1.02\leq Sb/Sr\leq1.2$. By setting the cross-sectional area ratio Sb/Sr to a value within such a range, the above-described braking action can be suitably generated.

In the reaction processing vessel 10 according to the first embodiment, the opening width Wr1 of the serpiginous channel 53 may be 0.55 mm to 0.95 mm, and preferably 0.65 mm to 0.85 mm. The bottom surface width Wr2 of the serpiginous channel 53 may be 0 mm to 0.95 mm, and preferably 0.4 mm to 0.6 mm. The depth Dr of the serpiginous channel 53 may be 0.5 mm to 0.9 mm, and preferably 0.6 mm to 0.8 mm. The taper angle Tr of the serpiginous channel 53 may be 0° to 45°, preferably 10° to 30°, and more preferably 15° to 25°. It should be noted that in the reaction processing vessel 10 according to the first embodiment, when the bottom surface width Wr2 of the serpiginous channel 53 is smaller than the opening width Wr1 such that the bottom surface width Wr2 is 0 mm or around 0 mm, the cross-sectional shape of the serpiginous channel 53 becomes close to a substantially inverse triangular shape. Further, it should be noted that when the taper angle Tr is reduced to be 0° or around 0°, the cross-sectional shape of the serpiginous channel 53 becomes close to a substantially rectangular shape.

The opening width Wb1 of the braking channel 54 may be 0.65 mm to 1.05 mm, and preferably 0.75 mm to 0.95 mm. The bottom surface width Wb2 of the braking channel 54 may be 0 mm to 1.05 mm, and preferably 0.5 mm to 0.7 mm. The depth Db of the braking channel 54 may be 0.5 mm to 0.9 mm, and preferably 0.6 mm to 0.8 mm. The taper angle Tb of the braking channel 54 may be 0° to 45°, and preferably 10° to 35°. It should be noted that in the reaction processing vessel 10 according to the first embodiment, when the bottom surface width Wb2 of the braking channel 54 is smaller than the opening width Wb1 such that the bottom surface width Wb2 is 0 mm or round 0 mm, the cross-sectional shape of the braking channel 54 becomes close to a substantially inverse triangle. Further, it should be noted that when the taper angle Tb is reduced to be 0° or around 0°, the cross-sectional shape of the braking channel 54 becomes close to a substantially rectangular shape.

By forming the serpiginous channel 53 and the braking channel 54 with the dimensions described above, the continuous movement of the sample (which may include a surfactant) becomes smooth, allowing for easy production also by a conventional manufacturing technique such as injection molding.

Figure 5:
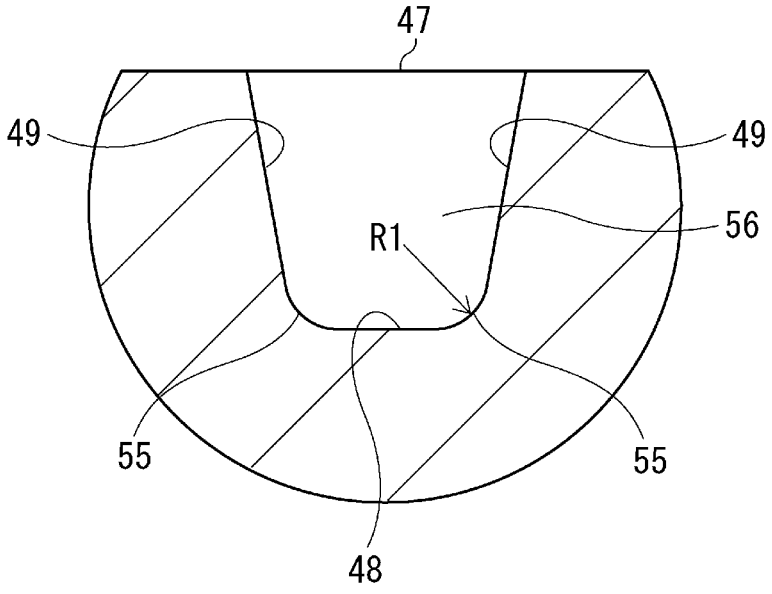
FIG. 5 is a diagram showing an exemplary variation of a serpiginous channel.

FIG. 5 shows an exemplary variation of a serpiginous channel. In the serpiginous channel 53 shown in FIG. 4A, the connecting parts between the bottom surface 48 and the side surfaces 49 have an angular shape. However, in the serpiginous channel 56 shown in FIG. 5, connecting parts 55 between the bottom surface 48 and the side surfaces 49 have a curved surface. In FIG. 5, the bottom surface 48 is flat. However, the bottom surface 48 may be a curved surface continuously connected to the connecting parts 55.

In the present embodiment, as described above, a serpiginous channel is employed for the purpose of improving the efficiency of heating by a heater. However, depending on an injection molding method in which a mold is filled with a resin at a high speed, there are some cases when the shape of such a channel becomes a resistance or an obstacle, and molding may not be performed properly, for example, causing a variation in the speed of filling with the resin or the generation of a void. In such a case, a weld line may be formed in a region including the serpiginous channel, and a recess such as a pit may be formed on the channel. Such a recess may obstruct the flow of the sample. As in the serpiginous channel 56 according to the present exemplary variation, by forming the connecting parts 55 to have a curved surface, the flow of the resin inside the mold at the time of injection molding becomes smooth. Thus, the generation of a weld line near a reaction channel can be suppressed. The curvature radius R1 of the connecting parts 55 may be, for example, 0.2 mm to 0.38 mm, and preferably 0.3 mm to 0.35 mm. In the same manner, in the braking channel 54, the connecting parts 58 between the bottom surface 51 and the side surfaces 52 may have a curved surface.

As shown in FIG. 1, the high temperature serpiginous channel 35 and the medium temperature serpiginous channel 37 include a plurality of bent parts 57. The curvature radius R2 of the bent parts 57 may be, for example, 0.3 mm to 10 mm, and preferably 0.5 mm to 6 mm. By setting the curvature radius of the bent parts 57 to be within such a range, the generation of a weld line can be further suppressed, and furthermore, when the sample moves inside the serpiginous channel, the moving speed of the sample can be easily kept constant in the bent parts 57.

Figure 6:
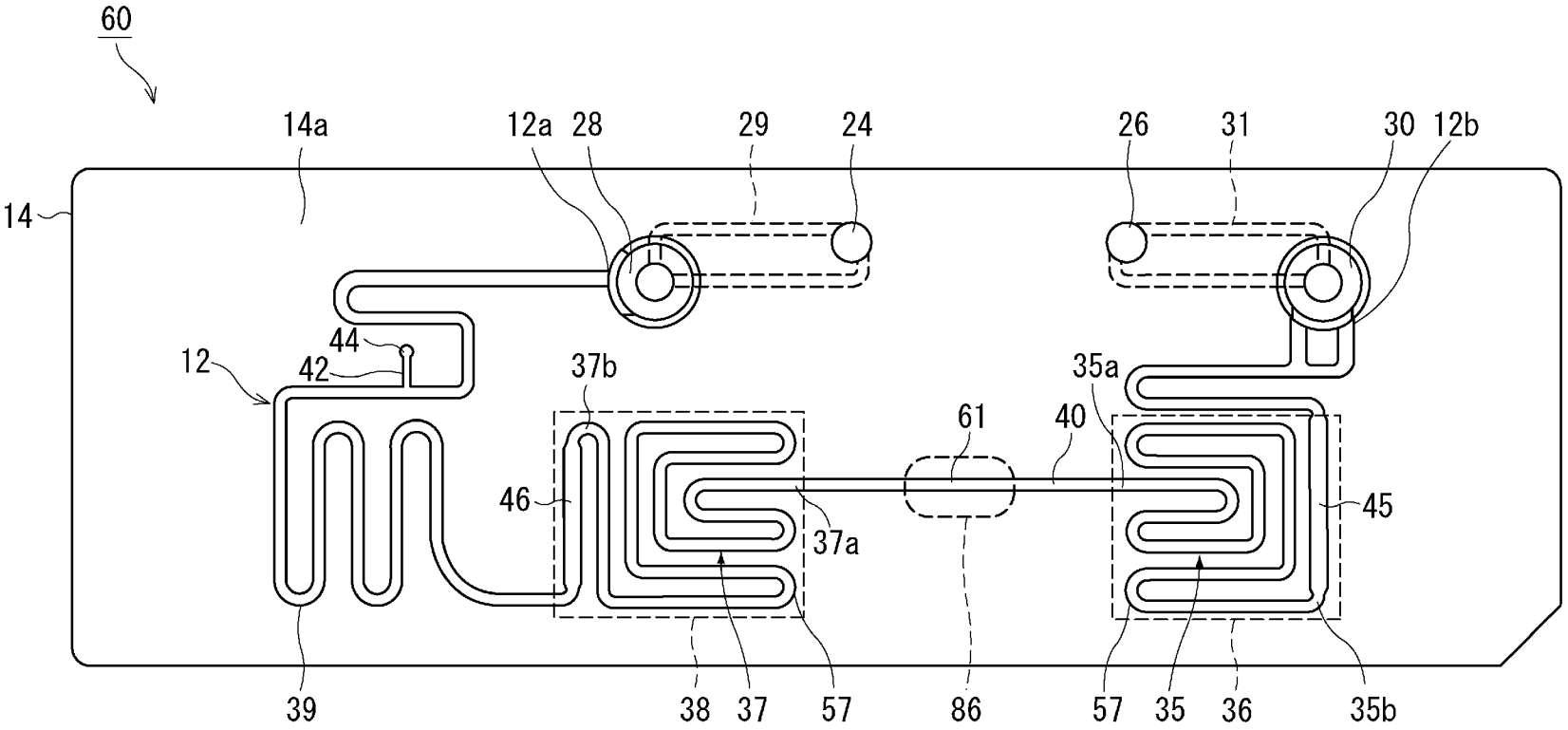
FIG. 6 is a plan view of a substrate provided in a reaction processing vessel according to an exemplary variation of the first embodiment.

FIG. 6 is a plan view of a substrate 14 provided in a reaction processing vessel 60 according to an exemplary variation of the first embodiment. The reaction processing vessel 60 according to the present exemplary variation is different from the reaction processing vessel 10 shown in FIG. 1 in that both the medium temperature serpiginous channel 37 and the medium temperature braking channel 46 are included in the medium temperature region 38. On the other hand, as for the high temperature serpiginous channel 35, both the high temperature serpiginous channel 35 and the high temperature braking channel 45 are included in the high temperature region 36, as in the reaction processing vessel 10. When stopping the sample in the high temperature region 36 during the PCR, the sample exists in at least both the high temperature serpiginous channel 35 and the high temperature braking channel 45. On the other hand, when stopping the sample in the medium temperature region 38 during the PCR, the sample exists in at least both the medium temperature serpiginous channel 37 and the medium temperature braking channel 46.

Also in the reaction processing vessel 60 according to the present exemplary variation, the high temperature braking channel 45 is formed such that the cross-sectional area thereof is larger than the cross-sectional area of the high temperature serpiginous channel 35. In the same way, the medium temperature braking channel 46 is formed such that the cross-sectional area thereof is larger than the cross-sectional area of the medium temperature serpiginous channel 37. Thereby, a brake action can be exerted on the sample flowing through the high temperature serpiginous channel 35 and the medium temperature serpiginous channel 37.

Second Embodiment

As described with reference to FIG. 3, the reaction processing apparatus 100 includes a fluorescence detector 140 in order to irradiate a sample moving inside the channel of the reaction processing vessel with excitation light during the PCR and measure the fluorescence emitted from the sample. In the fluorescence detector 140, the optical head 142 has a function of directionally irradiating the sample with excitation light and collecting fluorescence emitted from the sample. The focused spot diameter of the optical head 142 is usually about 0.15 mm to 0.45 mm, which is extremely small. Therefore, when arranging and fixing the optical head 142 to the reaction processing apparatus 100, very high accuracy is required. As a result, the workability for assembling may be reduced, and the cost for the parts may be increased. Therefore, in the second embodiment, a reaction processing vessel is provided that can overcome such a problem.

A reaction processing vessel according to the second embodiment of the present invention is also formed of a substrate, a sealing film attached to the substrate, and a filter. The same components as those of the reaction processing vessel 10 according to the first embodiment are denoted by the same reference numerals, and redundant description will be omitted as appropriate.

Figure 7:
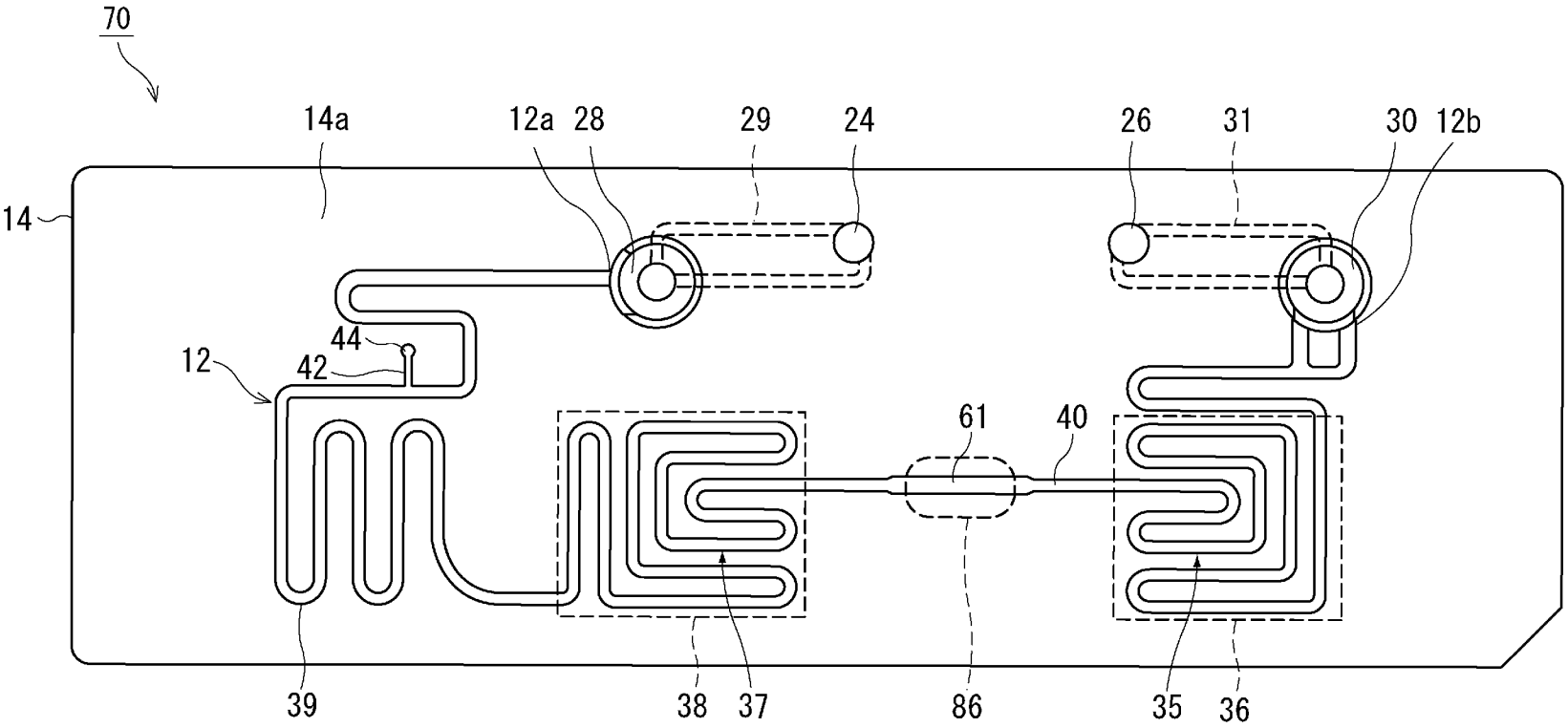
FIG. 7 is a plan view of a substrate provided in a reaction processing vessel according to the second embodiment of the present invention.

FIG. 7 is a plan view of a substrate 14 provided in a reaction processing vessel 70 according to the second embodiment of the present invention. The reaction processing vessel 70 according to the second embodiment does not include channels that correspond to the high temperature braking channel 45 and the medium temperature braking channel 46 of the reaction processing vessel 10 according to the first embodiment. Furthermore, the reaction processing vessel 70 according to the second embodiment has a configuration different from the reaction processing vessel 10 according to the first embodiment with respect to the detection channel 61.

Figure 8:
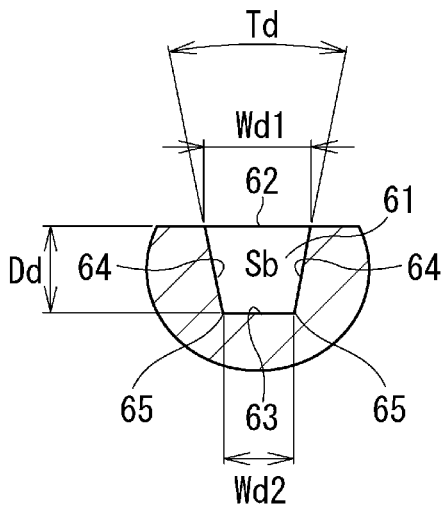
FIG. 8 is a diagram showing a cross section of a detection channel of the reaction processing vessel according to the second embodiment.

FIG. 8 shows a cross section of the detection channel 61 of the reaction processing vessel 70 according to the second embodiment. The detection channel 61 is provided in the connection channel 40 and is irradiated with excitation light in order to detect fluorescence from a sample. As shown in FIG. 8, the detection channel 61 is a trapezoidal channel and includes an opening 62, a bottom surface 63, and side surfaces 64 located on the respective sides of the bottom surface 63. The side surfaces 64 are formed in a tapered shape expanding from the bottom surface 63 toward the opening 62. Parameters defining the shape and dimensions of the detection channel 61 include a depth Dd, a taper angle Td, an opening width Wd1, a bottom surface width Wd2, and a cross-sectional area Sd.

In the reaction processing vessel 70 according to the second embodiment, the cross-sectional area Sd of the detection channel 61 is larger than the cross-sectional area Sr of the serpiginous channel 53 (see FIG. 4A). By making the cross-sectional area Sd of the detection channel 61 larger than the cross-sectional area Sr of the serpiginous channel 53 as described, the tolerance when assembling the optical head 142 to the reaction processing apparatus 100 is eased, thus improving the workability for assembling and lowering the cost for the parts.

In the reaction processing vessel 70 according to the second embodiment, the cross-sectional area ratio Sd/Sr of the cross-sectional area Sr of the serpiginous channel 53 and the cross-sectional area Sd of the detection channel 61 may be in a range of $1<Sd/Sr\leq1.8$, preferably in a range of $1.02\leq Sd/Sr\leq1.5$, and more preferably in a range of $1.02\leq Sd/Sr\leq1.2$.

In the reaction processing vessel 70 according to the second embodiment, the opening width Wr1 of the serpiginous channel 53 may be 0.55 mm to 0.95 mm, and preferably 0.65 mm to 0.85 mm. The bottom surface width Wr2 of the serpiginous channel 53 may be 0 mm to 0.95 mm, and preferably 0.4 mm to 0.6 mm. The depth Dr of the serpiginous channel 53 may be 0.5 mm to 0.9 mm, and preferably 0.6 mm to 0.8 mm. The taper angle Tr of the serpiginous channel 53 may be 0° to 45°, preferably 10° to 30°, and more preferably 15° to 25°. It should be noted that in the reaction processing vessel 70 according to the second embodiment, when the bottom surface width Wr2 of the serpiginous channel 53 is smaller than the opening width Wr1 such that the bottom surface width Wr2 is 0 mm or around 0 mm, the cross-sectional shape of the serpiginous channel 53 becomes close to a substantially inverse triangular shape. Further, it should be noted that when the taper angle Tr is reduced to be 0° or around 0°, the cross-sectional shape of the serpiginous channel 53 becomes close to a substantially rectangular shape.

In the reaction processing vessel 70 according to the second embodiment, the opening width Wd1 of the detection channel 61 may be 0.7 mm to 1.2 mm, and preferably 0.8 mm to 1.1 mm. The bottom surface width Wd2 of the detection channel 61 may be 0.15 mm to 1.2 mm, and preferably 0.55 mm to 0.95 mm. The depth Dd of the detection channel 61 may be 0.5 mm to 1.2 mm, and preferably 0.6 mm to 1.1 mm. The taper angle Td of the detection channel 61 may be 0° to 45°, preferably 10° to 35°, and more preferably 15° to 30°.

By forming the serpiginous channel 53 and the detection channel 61 with the dimensions described above, the continuous movement of the sample (which may include a surfactant) becomes smooth, allowing for easy production also by a conventional manufacturing technique such as injection molding.

Furthermore, by increasing the bottom surface width Wd2 in the cross section of the detection channel 61, the effect on the above-described tolerance can be further improved, and the distance between the opposing side surfaces 64 is increased. Thereby, the possibility that reflection, refraction, scattering, or the like at the side surfaces 64 hinders stable measurement of fluorescence can be lowered.

The bottom surface 63 of the detection channel 61 is formed on a plane parallel to the principal surface (i.e., the upper surface 14*a* and the lower surface 14*b*) of the substrate 14. Further, when the reaction processing vessel 70 is set in the reaction processing apparatus 100 (see FIG. 3), the optical head 142 of the fluorescence detector 140 is arranged such that the optical axis thereof is substantially perpendicular to the bottom surface 63 and the principal surface of the substrate 14. With such an arrangement, undesirable refraction or reflection of excitation light emitted from the optical head 142 to the sample or fluorescence emitted from the sample can be suppressed, and stable fluorescence intensity detection can be performed.

The bottom surface 63 and the side surfaces 64 are flat, and connecting parts 65 between the bottom surface 63 and the side surfaces 64 have an angular shape. That is, the connecting parts 65 between the bottom surface 63 and the side surfaces 64 substantially have no curved surface, and for example, the approximate curvature radius thereof may be 0.02 mm or less, preferably 0.01 mm or less, and more preferably 0.005 mm or less. In the fluorescence detection region 86, if a curved surface or the like is present in a part corresponding to a fluorescence emission part or an excitation light irradiation part, the curved surface or the like may cause irregular refraction or scattering, which may hinder stable measurement of fluorescence. Therefore, such a situation can be prevented from occurring by making the cross section of the detection channel 61 to have a shape in which a curved surface or the like is eliminated as much as possible.

Third Embodiment

Figure 9:
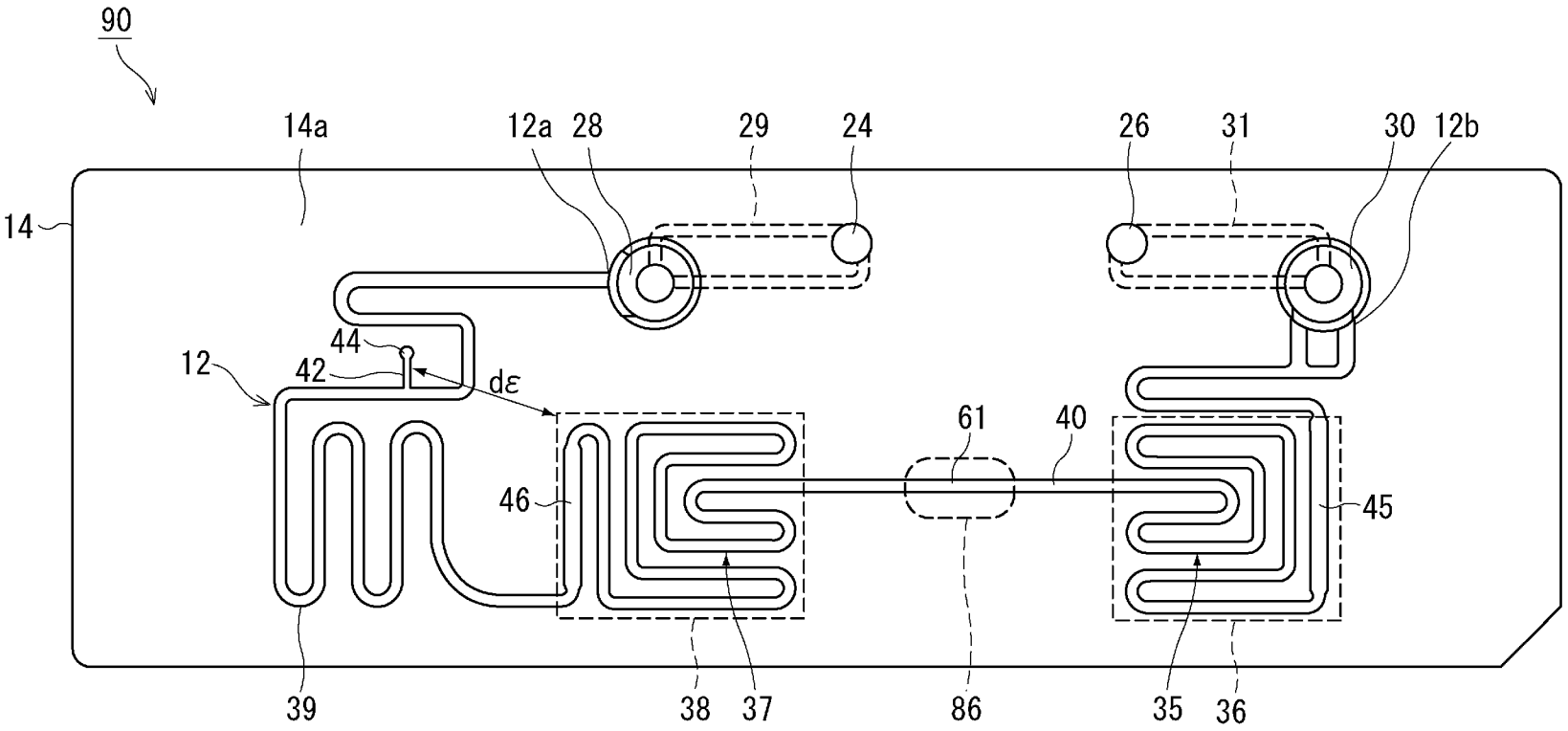
FIG. 9 is a plan view of a substrate provided in a reaction processing vessel according to the third embodiment of the present invention.
Figure 10:
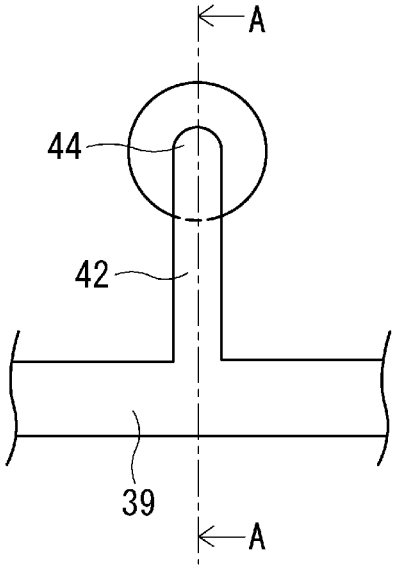
FIG. 10 is a schematic enlarged plan view showing the vicinity of a branch channel and a sample introduction port.
Figure 11:
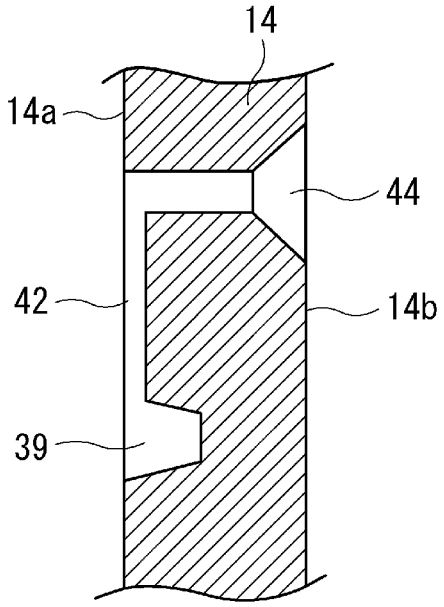
FIG. 11 is a schematic cross-sectional view of the vicinity of a branch channel and a sample introduction port shown in FIG. 10 that is sectioned along line A-A.

FIG. 9 is a plan view of a substrate 14 provided in a reaction processing vessel 90 according to the third embodiment of the present invention. FIG. 10 is a schematic enlarged plan view showing the vicinity of a branch channel 42 and a sample introduction port 44. FIG. 11 is a schematic cross-sectional view of the vicinity of the branch channel 42 and the sample introduction port 44 shown in FIG. 10 that is sectioned along line A-A.

As described above, the branch channel 42 is branched from a part of the buffer channel 39, and the sample introduction port 44 is formed at the distal end of the branch channel 42 so as to be exposed on the lower surface 14*b* of the substrate 14. The sample is introduced from this sample introduction port 44 and flows into the buffer channel 39 via the branch channel 42. The sample filling the buffer channel 39 is moved to the high temperature serpiginous channel 35 or the medium temperature serpiginous channel 37 and subjected to PCR. However, there is a possibility that the sample remains in the branch channel 42 and the sample introduction port 44. As described above, the high temperature region 36 and the medium temperature region 38 are heated by the heater of the reaction processing apparatus during the PCR. When heat applied to the high temperature region 36 and the medium temperature region 38 is transmitted to the branch channel 42 and the sample introduction port 44, the heat expands the air present in the branch channel 42 and the sample introduction port 44, and the sample that is remaining may be pushed out to the buffer channel 39 by the expanded air. In other words, in the channel 12, the sample to be subjected to PCR (referred to as "main sample") and the residual sample exist while being separated from each other. When the main sample and the residual sample exist while being separated from each other in the channel 12 as described above, there is a possibility that the propulsive power does not suitably act on the main sample even when the inside of the channel 12 is pressurized such that the sample cannot be appropriately moved.

Therefore, the reaction processing vessel 90 according to the third embodiment of the present invention is formed such that the distance dε between the medium temperature region 38 near the branch channel 42 and the sample introduction port 44, and the branch channel 42 and the sample introduction port 44 is 5 mm or more. When the substrate 14 is made of resin or glass, by setting the distance dε to be 5 mm or more, the transfer of heat from the medium temperature region 38 to the branch channel 42 and the sample introduction port 44 can be prevented or at least suppressed. Thus, troubles such as the ones described above can be prevented. The distance dε is 5 mm or more, preferably 6 mm or more, more preferably 7.5 mm or more, and even more preferably 9 mm or more. As a matter of course, the larger the distance dε, the better from the viewpoint of preventing heat transfer. However, if the distance dε is excessively large, the reaction processing vessel 90 is increased in size. The distance dε is 50 mm or less, preferably 40 mm or less, more preferably 30 mm or less, and even more preferably 25 mm or less.

In the present embodiment, since the medium temperature region 38 is closer to the branch channel 42 and the sample introduction port 44 than the high temperature region 36, the distance dε between the medium temperature region 38 and the branch channel 42 and the sample introduction port 44 is defined. However, in another embodiment, when the high temperature region is closer to the branch channel 42 and the sample introduction port 44 than the medium temperature region, the distance dε between the high temperature region and the branch channel and the sample introduction port is defined. That is, the distance dε between the reaction region closest to the branch channel 42 and to the sample introduction port 44 among the plurality of reaction regions and the branch channel 42 and the sample introduction port 44 may be set to be 5 mm or more.

Fourth Embodiment

Figure 12:
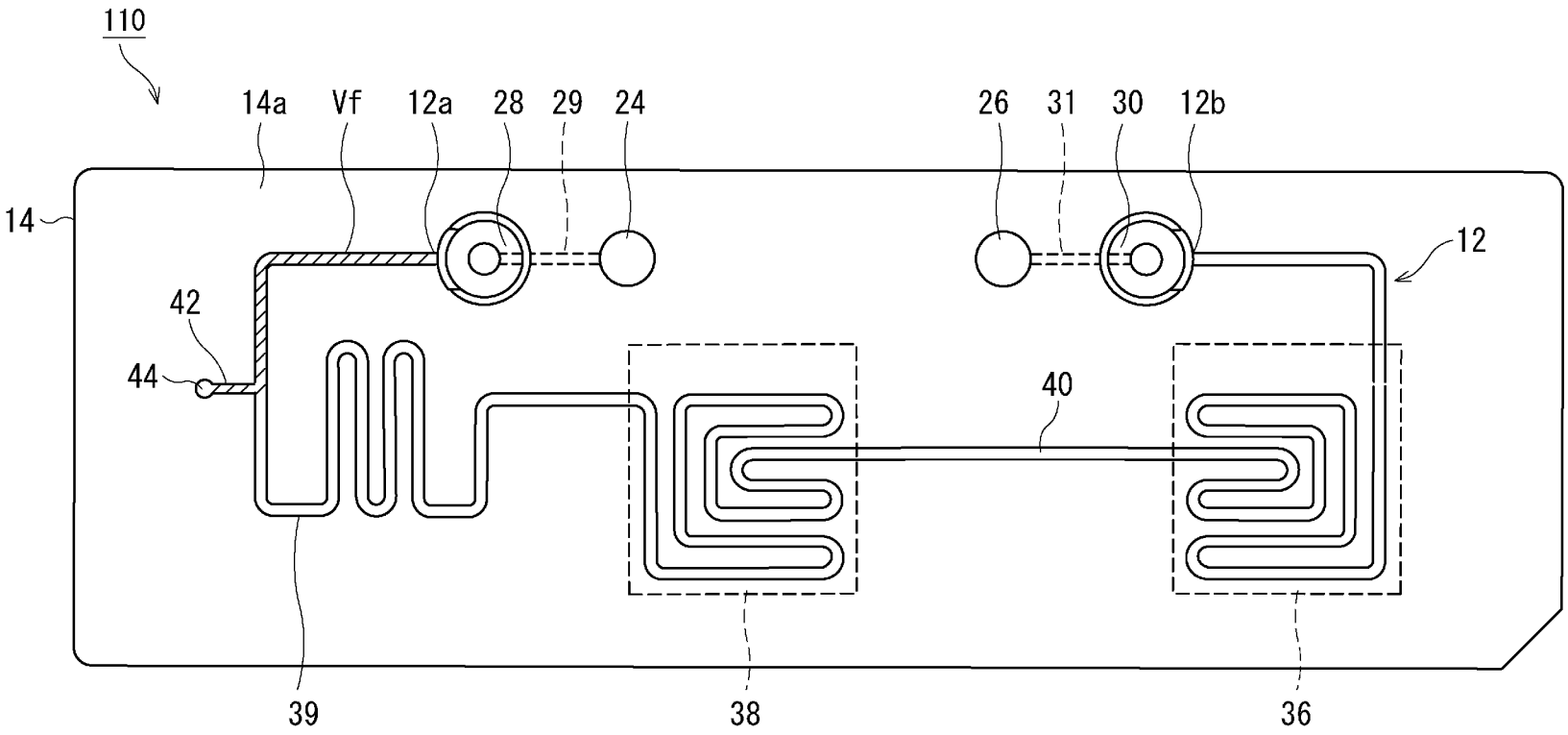
FIG. 12 is a plan view of a substrate provided in a reaction processing vessel according to the fourth embodiment of the present invention.

FIG. 12 is a plan view of a substrate 14 provided in a reaction processing vessel 110 according to the fourth embodiment of the present invention. The branch channel 42 is branched from a part of the buffer channel 39, and the sample introduction port 44 is formed at the distal end of the branch channel 42 so as to be exposed on the lower surface 14*b* of the substrate 14. A sample introduced from the sample introduction port 44 flows toward one of filters, comes into contact with the filter surface, and a part of the filter surface may be buried or clogged by the sample. When the filter is partially or entirely clogged, the propulsive power of a syringe pump, a diaphragm pump, a blower, or the like serving as a liquid sending system is less likely to act on the sample through the filter. Therefore, the reciprocation between the high temperature region and the medium temperature region may not be performed normally, which may hinder the PCR reaction.

Therefore, in the reaction processing vessel 110 according to the fourth embodiment of the present invention, given that the volume of a channel from the sample introduction port 44 to a filter closest to the sample introduction port (the first filter 28 in FIG. 12) is denoted by Vf and that the volume of the sample introduced from the sample introduction port is denoted by Vs, the following is satisfied:

$k \times Vs < Vf$ (where k is a coefficient and represents a real number of 0.1 to 10)

The coefficient k is determined based on the volume Vs of the sample to be introduced, the type and viscosity of the solvent of the sample to be introduced, the amount and properties of substances such as a surfactant added to the sample, the wettability with and the resistance to the surface of the substrate, the channel sealing film, etc., or the like. The value of the coefficient k is preferably 0.3 to 5, more preferably 0.4 to 2. Further, even when the entire amount of the introduced sample flows toward the filter closest to the sample introduction port, the coefficient k may be larger than 1 ($1<k$) from the viewpoint that the tip of the sample does not come into contact with the filter surface. On the other hand, when the coefficient k is large, Vf becomes large. Therefore, the coefficient k may be 0.4 to 0.6 from the viewpoint of a space saving effect of the principal surface of the substrate.

The volume Vs of the sample to be introduced is 1 μL to 50 μL (microliter), preferably 5 μL to 40 μL, and more preferably 10 μL to 30 μL. When the cross-sectional shape of the channel is represented in FIG. 4A, the length Lh of the channel from the sample introduction port 44 to a filter closest to the sample introduction port 44 is 2 mm to 200 mm, and is preferably 5 mm to 100 mm, more preferably 10 mm to 50 mm, and still more preferably 20 mm to 40 mm. If the length Lh of the channel is too small, the possibility of the sample coming into contact with the filter increases. If the length Lh is too large, the size of the substrate 14 is caused to be large. This is not preferable from the viewpoint of space saving of the substrate and also hinders miniaturization of the reaction processing apparatus.

At least a part of the channel from the sample introduction port 44 to the filter closest to the sample introduction port 44 may be a channel with a cross section shown in FIG. 4B or a cross section shown in FIG. 8. By making the cross-sectional area of the channel from the sample introduction port 44 to the filter relatively large, the length Lh can be reduced. Further, a braking action for preventing overrun of the sample during a reaction process such as PCR can be expected, and contamination of the filter by the sample can be prevented.

For example, even when a worker introduced a sample after mistakenly peeling off a sealing film that is sealing the filter closest to the sample introduction port 44 or a sealing film that is sealing an air communication port closest to the filter at the time of introducing the sample from the sample introduction port 44, it is possible to prevent the sample from flowing in the direction of the filter near the sample introduction port and coming into contact with the filter resulting in contaminating the filter.

Described above is an explanation based on the embodiments of the present invention. These embodiments are intended to be illustrative only, and it will be obvious to those skilled in the art that various modifications to constituting elements and processes could be developed and that such modifications are also within the scope of the present invention.

For example, the reaction processing vessel according to one embodiment may include the high temperature braking channel 45 and the medium temperature braking channel 46 in the reaction processing vessel 10 according to the first embodiment described above and the detection channel 61 in the reaction processing vessel 70 according to the second embodiment described above. In this case, it is possible to realize a reaction processing vessel capable of exhibiting both effects of these two embodiments.

INDUSTRIAL APPLICABILITY

The present invention is applicable to a polymerase chain reaction (PCR).

What is claimed is:

1. A reaction processing vessel for processing a sample, comprising:

a substrate having a principal surface, and a groove channel formed on the principal surface of the substrate, said groove channel comprising a first continuous serpiginous channel having a first end and a second end and a second continuous serpiginous channel having a first end and a second end, wherein a plurality of reaction regions, each maintained at a predetermined temperature, are set at separate areas along the principal surface of the substrate, and two of said reaction regions are separated along the principal surface of the substrate by a third region, wherein the sample repeatedly moves in a reciprocating manner between the plurality of reaction regions in order to cause a reaction, wherein the channel comprises a separate serpiginous channel included in each of the plurality of reaction regions, and a connection channel connecting serpiginous channels in two adjacent regions of the plurality of reaction regions, wherein the connection channel comprises a single detection channel portion adapted to be irradiated with excitation light in order to detect fluorescence from a sample flowing inside the channel, wherein the serpiginous channel and the detection channel has an opening, a bottom surface, and side surfaces formed in a tapered shape expanding from the bottom surface toward the opening, wherein the cross-sectional area of the detection channel is larger than the cross-sectional area of the serpiginous channel, and wherein the bottom surface width of the detection channel is larger than the bottom surface width of the serpiginous channel.

2. The reaction processing vessel according to claim 1, wherein given that the cross-sectional area of the serpiginous channel is denoted by Sr and that the cross-sectional area of the detection channel is denoted by Sd, a cross-sectional area ratio Sd/Sr is in a range of $1<Sd/Sr\leq1.8$.

3. The reaction processing vessel according to claim 2, wherein the cross-sectional area ratio Sd/Sr is in a range of $1.02\leq Sd/Sr\leq1.5$.

4. The reaction processing vessel according to claim 2, wherein the cross-sectional area ratio Sd/Sr is in a range of $1.02\leq Sd/Sr\leq1.2$.

5. The reaction processing vessel according to claim 1, wherein the serpiginous channel has an opening width of 0.55 mm to 0.95 mm, a bottom surface width of 0 mm to 0.95 mm, a depth of 0.5 mm to 0.9 mm, and a taper angle of 0° to 45°, and wherein the detection channel has an opening width of 0.7 mm to 1.2 mm, a bottom surface width of 0.15 mm to 1.2 mm, a depth of 0.5 mm to 1.2 mm, and a taper angle of 0° to 45°.

6. The reaction processing vessel according to claim 1, wherein the bottom surface in the detection channel is formed on a flat surface parallel to the principal surface of the substrate.

7. The reaction processing vessel according to claim 6, wherein connecting parts between the bottom surface and the side surfaces of the detection channel are formed in an angular shape.

8. The reaction processing vessel according to claim 6, wherein the detection channel has a predetermined length that exceeds the bottom surface width of the detection channel in a direction along the connection channel.

9. The reaction processing vessel according to claim 1, wherein the detection channel has a bottom surface width of 0.55 mm to 1.2 mm.

10. A reaction processing vessel for processing a sample, comprising:

a substrate having a principal surface, and a groove channel formed on the principal surface of the substrate, said groove channel comprising a first continuous serpiginous channel having a first end and a second end and a second continuous serpiginous channel having a first end and a second end, wherein a first temperature region maintained at a first temperature and a second temperature region maintained at a second temperature lower than the first temperature are set at separate areas along the principal surface of the substrate, and are separated by a third temperature region, wherein the sample repeatedly moves in a reciprocating manner between the first temperature region and the second temperature region in order to cause a reaction, wherein the first temperature region includes the first serpiginous channel, wherein the second temperature region includes the second serpiginous channel, wherein the third temperature region includes a single linear connection channel that is formed between one of the first and second ends of the first serpiginous channel and one of the first and second ends of the second serpiginous channel, wherein a first linear braking channel for lowering a speed of the sample is formed at the other of the first and second ends of the first serpiginous channel, wherein a second linear braking channel for lowering a speed of the sample is formed at the other of the first and second ends of the second serpiginous channel, wherein the cross-sectional area of the first braking channel is larger than the cross-sectional area of the first serpiginous channel, and wherein the cross-sectional area of the second braking channel is larger than the cross-sectional area of the second serpiginous channel.

11. The reaction processing vessel according to claim 10, wherein given that the respective cross-sectional areas of the first serpiginous channel and the second serpiginous channel are denoted by Sr and that the respective cross-sectional areas of the first braking channel and the second braking channel are denoted by Sb, a cross-sectional area ratio Sb/Sr is in a range of $1<Sb/Sr\leq1.8$.

12. The reaction processing vessel according to claim 11, wherein the cross-sectional area ratio Sb/Sr is in a range of $1.02\leq Sb/Sr\leq1.5$.

13. The reaction processing vessel according to claim 11, wherein the cross-sectional area ratio Sb/Sr is in a range of $1.02\leq Sb/Sr\leq1.2$.

14. The reaction processing vessel according to claim 10, wherein the first serpiginous channel, the second serpiginous channel, the first braking channel, and the second braking channel have an opening, a bottom surface, and side surfaces formed in a tapered shape expanding from the bottom surface toward the opening.

15. The reaction processing vessel according to claim 14, wherein the first serpiginous channel and the second serpiginous channel have an opening width of 0.55 mm to 0.95 mm, a bottom surface width of 0 mm to 0.95 mm, a depth of 0.5 mm to 0.9 mm, and a taper angle of 0° to 45°, and wherein the first braking channel and the second braking channel have an opening width of 0.65 mm to 1.05 mm, a bottom surface width of 0 mm to 1.05 mm, a depth of 0.5 mm to 0.9 mm, and a taper angle of 0° to 45°.

16. The reaction processing vessel according to claim 14, wherein connecting parts between the bottom surface and the side surfaces have a curved surface.

17. The reaction processing vessel according to claim 16, wherein the curvature radius of the connecting parts is 0.2 mm to 0.38 mm.

18. The reaction processing vessel according to claim 10, wherein the first serpiginous channel and the second serpiginous channel include a bent part, and wherein the curvature radius of the bent part is 0.3 mm to 10 mm.

19. The reaction processing vessel according to claim 10, further comprising a branch channel branched from the channel and a sample introduction port provided in the branch channel, wherein the distance between a temperature region closest to the branch channel and to the sample introduction port among the first temperature region and the second temperature region, and the branch channel and the sample introduction port is 5 mm or more.

20. The reaction processing vessel according to claim 10, further comprising a pair of filters provided at the respective ends of the channel, a branch channel branched from the channel, and a sample introduction port provided in the branch channel, wherein given that the volume of the channel from the sample introduction port to a filter closest to the sample introduction port is denoted by Vf and that the volume of the sample introduced from the sample introduction port is denoted by Vs, the following is satisfied: $k \times Vs < Vf$ (where k represents a real number of 0.1 to 10).

21. The reaction processing vessel according to claim 10, further comprising a pair of filters provided at the respective ends of the channel, a branch channel branched from the channel, and a sample introduction port provided in the branch channel, wherein, when the volume of the sample introduced from the sample introduction port is 1 μL to 50 μL, the length of the channel from the sample introduction port to a filter closest to the sample introduction port is 2 mm to 200 mm.

22. The reaction processing vessel according to claim 10, wherein the first braking channel is formed within the first temperature region and the second braking channel is formed adjacent to and outside of the second temperature region.

23. The reaction processing vessel according to claim 10, wherein the first and second temperature regions are heated regions and the third temperature region is an unheated region.

24. The reaction processing vessel according to claim 10, wherein the groove channel comprises a first end and a second end, and a first filter disposed between said first end and said first braking channel, and a second filter disposed between said second end and said second braking channel.

25. A reaction processing vessel for processing a sample, comprising:

a substrate having a principal surface, and a groove channel formed on the principal surface of the substrate, said groove channel comprising a first continuous serpiginous channel having a first end and a second end and a second continuous serpiginous channel having a first end and a second end, wherein a first temperature region maintained at a first temperature and a second temperature region maintained at a second temperature lower than the first temperature are set at separate areas along the principal surface of the substrate, and are separated by a third temperature region, wherein the sample repeatedly moves in a reciprocating manner between the first temperature region and the second temperature region in order to cause a reaction, wherein the first temperature region includes the first serpiginous channel, wherein the second temperature region includes the second serpiginous channel, wherein the third temperature region includes a linear connection channel that is formed between one of the first and second ends of the first serpiginous channel and one of the first and second ends of the second serpiginous channel, wherein a first linear braking channel for lowering a speed of the sample is formed at the other of the first and second ends of the first serpiginous channel, wherein a second linear braking channel for lowering a speed of the sample is formed at the other of the first and second ends of the second serpiginous channel, wherein the connection channel includes a detection channel portion that is adapted to be irradiated with excitation light in order to detect fluorescence from a sample flowing inside the channel, wherein the cross-sectional area of the first braking channel is larger than the cross-sectional area of the first serpiginous channel, wherein the cross-sectional area of the second braking channel is larger than the cross-sectional area of the second serpiginous channel, and wherein the cross-sectional area of the detection channel is larger than the cross-sectional area of the first serpiginous channel and the cross-sectional area of the second serpiginous channel.

26. The reaction processing vessel according to claim 25, wherein the first braking channel is formed within the first temperature region and the second braking channel is formed adjacent to and outside of the second temperature region.

27. The reaction processing vessel according to claim 25, wherein the first and second temperature regions are heated regions and the third temperature region is an unheated region.

28. The reaction processing vessel according to claim 25, wherein the groove channel comprises a first end and a second end, and a first filter disposed between said first end and said first braking channel, and a second filter disposed between said second end and said second braking channel.

* * * * *